United States Patent [19]

Urban, Jr.

[11] 4,078,566

[45] Mar. 14, 1978

[54] UNIT-DOSING-NIPPLE

[76] Inventor: Joseph J. Urban, Jr., 5 James Dr., Richboro, Pa. 18954

[21] Appl. No.: 644,951

[22] Filed: Dec. 29, 1975

[51] Int. Cl.[2] ..... A61J 11/00

[52] U.S. Cl. ..... 128/252

[58] Field of Search ..... 128/252, 222, 359, 360, 128/260, 272, 231, 232; 215/11 R, 11 C, 211, 295, 298, 305; 222/490, 541; 426/122, 123, 117

[56] References Cited

U.S. PATENT DOCUMENTS

| | | | |
|---|---|---|---|
| 2,142,278 | 1/1939 | Mendelson | 128/272 X |
| 2,509,369 | 5/1950 | Roberson | 222/541 X |
| 2,836,321 | 5/1958 | Soltesz et al. | 215/11 R |
| 2,885,104 | 5/1959 | Greenspan | 215/11 R |
| 2,889,829 | 6/1959 | Tannenbaum et al. | 128/252 |
| 2,907,485 | 10/1959 | Lunden | 215/11 R |
| 3,424,157 | 1/1969 | DiPaolo | 128/252 |
| 3,610,248 | 10/1971 | Davidson | 128/222 |
| 3,804,952 | 4/1974 | MacDonald | 215/11 R |

FOREIGN PATENT DOCUMENTS

| | | | |
|---|---|---|---|
| 869,411 | 6/1953 | Germany | 128/232 |
| 720,652 | 12/1954 | United Kingdom | 128/232 |

*Primary Examiner*—John D. Yasko
*Attorney, Agent, or Firm*—David H. Klein

[57] ABSTRACT

A medicinal container with a general shape of a "nipple" or "pacifier" constructed in such a manner that a chamber is formed, said chamber serving as a reservoir for a liquid, oleaginous, semi-solid, or solid medicament or vacuum completely protected by the members of the device from the external environment and in which case, when said device contains a vacuum in said chamber said device must be constructed in a vacuum or subject to vacuum prior to completion of construction and said device containing said vacuum is then to be delivered to an intermediate, such as a pharmacist, for installation of a specific dose of a medicament into said chamber of said device, said installation being accomplished by use of a syringe with needle by inserting said needle through self-sealing injection-port present on said device, but, in any case, when said device is received by the end-user or consumer it contains a medicament, said medicament being isolated from the external environment from the time it is instilled into the device until the device is manipulated to expose two cavities or holes, one hole in the tip of the nipple allowing the medicament to be sucked into the mouth of an infant, child or animal user by the sucking action of the user and the second cavity or hole on the upper portion of the base, opposite the first hole, allowing air to enter the chamber to facilitate the flow of the medicament through the hole in the tip of the nipple as the user exerts sucking action on said nipple.

31 Claims, 2 Drawing Figures

Fig. 2
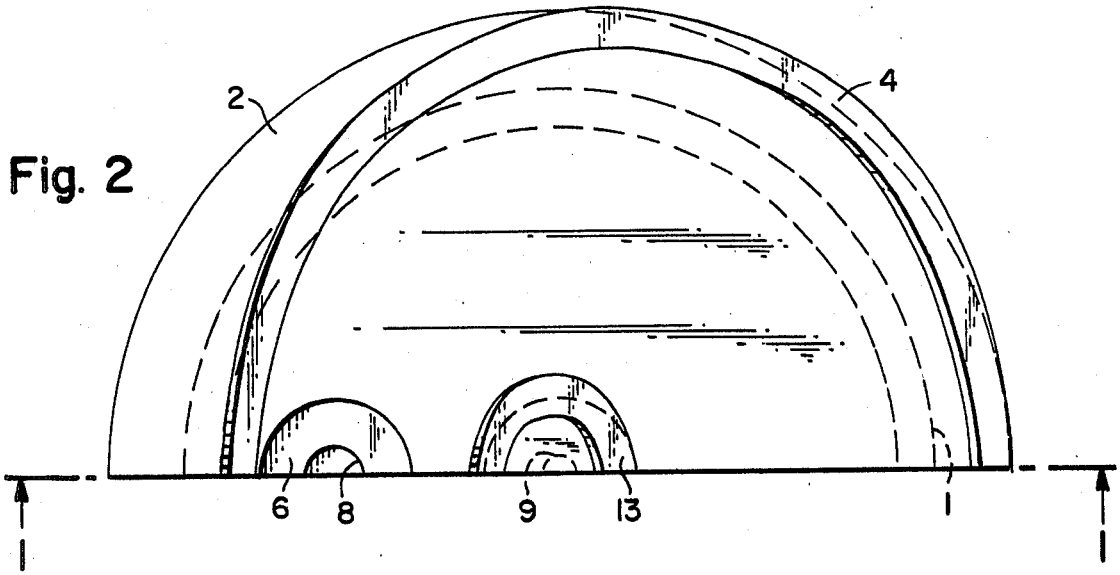
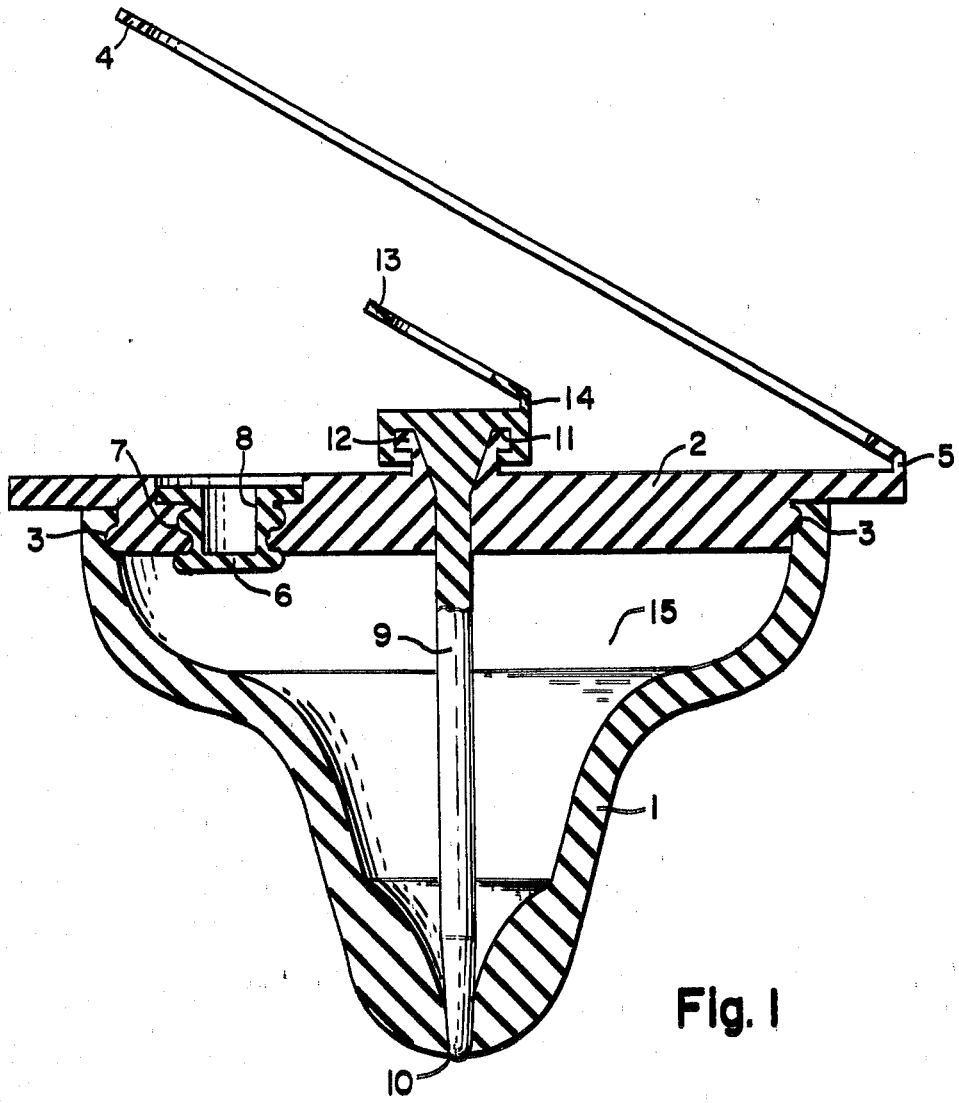
Fig. 1

UNIT-DOSING NIPPLE

This present invention relates to devices commonly known as a "baby bottle nipple" or a "pacifier" and more specifically to devices of the "nipple" or "pacifier" nature used for administering drugs, medicines and the like to infants, children or animals. This invention has for its primary purpose to provide, in a manner as hereinafter set forth, a new and improved device of this character which may be used for the delivery of drugs, medicines and the like of a liquid, oleaginous, semi-solid, solid and the like nature, collectively referred to hereinafter as medicaments, to infants, children or animals. Another specific purpose of this device is to provide a versatile device which can be either filled with a medicament using automated means such as filling machines or assembled while subject to vacuum, subsequently delivered to an intermediate such as a pharmacist and subsequently filled with a medicament by conventional means such as syringe with needle. Another purpose of this invention is to provide a device which can contain a medicament for prolonged periods of time, such as days, weeks, months and years, without said medicament ever having made contact with the external environment until said device is manipulated to allow the delivery of the medicament to the consumer. Another purpose of this invention is to provide a container that can deliver a single, specific dose of a medicament, said medicament having been accurately measured and instilled in said device, by someone trained in the art, sometime prior to use by the consumer. Another purpose of this invention is to provide a container, that once having served its purpose of delivering an exact amount of medicament to the consumer, which is disposable.

Another significant purpose of this invention is its ability to permit the medicament contained therein to be asperated into the mouth or throat of the ultimate user, infant, child or animal. This is achieved by preparing the invention from flexible components. Then should the ultimate user be unable or refuse to suck on the invention, the medicament can be delivered by squeezing the invention while it is in proper position and alignment in the mouth of the ultimate user.

Also, the invention may be prepared from low ultra-violet light transmitting materials to increase the stability and retard the degradation of ultra-violet light sensitive medicaments such as vitamins.

The invention will be better understood and purposes and objects other than those set forth above will become apparent when reference being had to the accompanying drawings forming a part hereof, wherein like numerals refer to like parts throughout and in which:

FIG. 1 is a view in verticle section through the invention device being essentially a medicinal container with the general shape of a "baby bottle nipple" or a "pacifier".

FIG. 2 is a top plan view of the same device.

Referring now to the drawings, the nipple member 1 of the device is fabricated of rubber, plastic, film or other resilient material which may be received within the mouth of an infant, child, or animal. The nipple member 1 is securely attached to a ring-shaped plate member 2 by threads 3. The ring-shaped plate member 2 is fabricated of rubber, plastic, film or other resilient material. The ring-shaped plate member 2 has an extension of itself a carrying ring 4 preferably attached by a simple hinge 5 at one point of the periphery of the ring-shaped plate member 2 so as the carrying ring 4 can either lay flat against the ring-shaped plate member 2 or be raised. An injection-port stopper 6 extends through the ring-shaped plate member 2 and is preferably fabricated of rubber, plastic, film or other resilient material and affording an area which is self-sealing after permeation with a needle or syringe. The injection-port stopper 6 is of such design that as it communicates with the ring-shaped plate member 2 an air-tight snap joint 7 is formed therewith. The upper section of the injection-port stopper 6 is of greater diameter than its lower section so as to prevent its being pushed entirely through the ring-shaped plate 2 when it is being inserted into the same. A cavity 8 exists in the center of the injection-port stopper 6 but does not extend entirely through the injection-port stopper 6. The purpose of said cavity 8 in the injection-port stopper 6 is to act as a reservoir of a rod or punch which may be used to facilitate the insertion of the injection-port stopper 6 into the ring-shaped plate member 2. The sealing rod 9 extends through the ring-shaped plate member 2, continues along the axis of the device through the nipple member 1 and terminates just exterior to the outflow opening 10 of nipple member 1 forming an air tight compression seal therewith. The sealing rod 9 is fabricated of rubber, plastic, film or other resilient material. When in place, the sealing rod 9 forms an air-tight snap joint 11 with an extension member 12 of the ring-shaped plate member 2. A slight taper exists at the upper portion of sealing rod 9 where it communicates with the extension member 12 and the ring-shaped plate member 2 so as to insure an even more complete air-tight seal between sealing rod 9 and the ring-shaped plate member 2. The thickness of nipple member 1 increases where it communicates with the sealing rod 9 while the sealing rod 9 is tapered at this point of communication the purpose of these designs to increase the surface contact area between sealing rod 9 and nipple member 1 to insure a more complete air-tight compression seal between sealing rod 9 and nipple member 1. The pulling ring 13 is an extension of the sealing rod 9 and is attached to the sealing rod 9 by means of a simple hinge 14 at one point of the periphery of the top of the sealing rod 9. The simple hinge 14 enables the pulling ring 13 to lay flat against the top of the sealing rod 9 until the pulling ring 13 be needed to aid in the removal of the sealing rod 9 at which time the pulling ring 13 is raised. Thus, when this invention is constructed in the manner described above, there exists an air-tight chamber cavity 15 completely isolated and sealed from the environment surrounding the device.

The invention having been constructed as stated above can either be filled with a medicament prior to insertion of the injection-port stopper 6 into the ring-shaped plate member 2 or filled with a medicament after insertion of the injection-port stopper 6 into the ring-shaped plate member 2 in this latter case by instilling said medicament with a syringe with needle through the injection-port stopper 6 said injection-port stopper 6 sealing itself when the needle is withdrawn. In any case, the device containing a medicament in its air-tight chamber cavity 15 is made ready for use by removing the sealing rod 9 by exerting a pulling force on the pulling ring 13 thus exposing an opening in the nipple member 1 at the outflow opening 10 and an opening in the ring-shaped plate member 2 at the point where the sealing rod 9 communicates therewith.

The above-shown and described drawings better illustrate some important features of the present invention. More particularly, the sealing rod 9 also maintains the integrity of the openings in the nipple member 1 and the ring-shaped member 2 should the invention be subjected to otherwise adverse conditions, such as extreme temperatures which occur during sterilization.

Also, the present invention may contain a powder or solid medicament in its air-tight chamber cavity 15 enabling said powder or solid medicament to be reconstituted with a liquid, such as water, by injecting said liquid into the air-tight chamber cavity through the injection port stopper 7. In this embodiment said liquid will be either a solubilizing medium or act as a suspension medium for the powder or solid. Also in this embodiment, the sealing rod may be equipped with collapsible paddles which enable the rod, upon twisting, to create a greater shear force for stirring. The collapsible paddles fold into the dimensions of the rod permitting passage through the opening in the ring-shaped plate member 2.

As mentioned earlier, the present invention may be constructed in a vacuum or subject to vacuum prior to being filled with the medicament, it may be delivered in this state to one skilled in the art, such as a pharmacist, for filling at a later time. Accordingly, such a skilled artisan may inject, using a syringe with a needle, the medicament through the self-sealing injection port stopper 16 into the air-tight chamber cavity 15.

Accordingly, the invention may be delivered with no medicament in its air-tight chamber cavity 15 and filled individually as the need arises.

Furthermore, the aforesaid ability of the invention to have its content asperated into the mouth of the ultimate user arises from using flexible components. The invention so prepared from flexible components may be inserted in the usual manner into the mouth of the ultimate user and the nipple-member 1 squeezed while the opening in the ring-shaped plate member is covered, such as by placing a finger over said opening.

The nipple member 1 of said device is subsequently received into the mouth of an infant, child or animal and the medicament sucked from the air-tight chamber cavity 15 through the outflow opening 10 by the sucking action exerted by the infant, child or animal as the air now entering the air-tight chamber cavity 15 through the exposed hole in the ring-shaped plate member 2 helps facilitate the flow of the medicament from the air-tight chamber cavity 15 by preventing a vacuum from forming in said air-tight chamber cavity 15.

The objects set forth at the outset of this specification now having been achieved in view of the foregoing description are now combined with the description in the following claims.

Accordingly, I claim:

1. A medicinal container with the general shape of a "baby bottle nipple" or "pacifier" all parts and members being composed of rubber, plastic, film, or other resilient materials comprising, a nipple member with an outflow opening, a ring-shaped plate member attached to the nipple member preferably by threads forming an air-tight seal between both members and said ring-shaped plate member having attached to itself a carrying ring, an injection-port stopper extending through the ring-shaped plate member and forming an air-tight snap joint with the ring-shaped plate member and said injection-port stopper serving to seal the device after instillation of a medicament into the air-tight chamber cavity and said injection-port stopper also affording an area which is self-sealing after permiation with a needle of a syringe for the purpose of injecting a medicament into the air-tight chamber cavity, a sealing rod extending through the ring-shaped plate member continuing along the verticle axis of the device through the outflow opening of the nipple member where it then terminates said sealing rod forming an air-tight snap joint with the ring-shaped plate member and an air-tight compression seal with the nipple member and said sealing rod having attached to itself a pulling ring, an air-tight chamber cavity into which is instilled the medicament, in which case, the device when consisting of the above and filled with a medicament will, when manipulated and made ready for administering the medicament by removing the sealing rod by exerting a pulling force on the pulling ring thus exposing openings in the nipple member at the outflow opening and in the ring-shaped plate member, deliver the medicament contained therein when placed in the mouth of an infant, child or animal by allowing the medicament to be sucked through the outflow opening of the nipple member aided by the air now entering the air-tight chamber cavity through the hole now existant in the ring-shaped plate member.

2. A medicinal container according to claim 1 whose sealing-rod not only functions to form air-tight seals with the nipple member and ring-shaped plate member but also functions as a device for maintaining the integrity of the openings in the nipple member and ring-shaped plate member when said device is subject to adverse conditions such as extremes in temperature.

3. A medicinal container according to claim 1 containing a powder or solid medicament in its air-tight chamber cavity in which case said powder or solid medicament is reconstituted with a liquid such as water by injecting said liquid into the air-tight chamber cavity through the injection-port stopper with a syringe with needle said liquid then solubilizing or acting as a suspension media for the powder or solid.

4. A medicinal container according to claim 1 containing no medicament but prepared or constructed in a vacuum in which case the air-tight chamber cavity of said device contains a vacuum thus allowing a medicament to be instilled at some later time by one skilled in the art, such as a pharmacist, using a syringe with needle and injecting the medicament through the self-sealing injection-port stopper and into the air-tight chamber cavity.

5. A medicinal container according to claim 4 containing a powder or solid medicament in its air-tight chamber cavity.

6. A medicinal container according to claim 1 which serves to deliver a specific dose of a medicament and once having served its purpose said device may be disposed of.

7. A medicinal container according to claim 1 prepared and subjected to sterilizing conditions thus insuring the sterility of the medicament till time of use.

8. A medicinal container according to claim 4 prepared and subjected to sterilizing conditions thus insuring the sterility of the air-tight chamber cavity till time of instillation of the medicament.

9. A medicinal container according to claim 5 prepared and subjected to sterilizing conditions thus insuring the sterility of the medicament in the air-tight chamber cavity till time of reconstitution.

10. A medicinal container according to claim 1 however composed of moderately flexible members thus being versatile in offering an alternate means of administering the medicament in that if at time of use the infant, child or animal refuses to suck the medicament from the device said medicament may be asperated into the mouth or throat of said infant, child, or animal by placing one finger over the opening in the ring-shaped plate member while exerting pressure with two other fingers on opposite walls of the nipple member thus causing the medicament to be evacuated from the air-tight chamber cavity through the outflow opening.

11. A medicinal container according to claim 1 assuring that the medicament contained in the air-tight chamber cavity does not contact the external environment from the time said medicament is instilled in the air-tight chamber cavity till the time said device is so manipulated to deliver said medicament.

12. A medicinal container having the general shape of a "baby bottle nipple" or "pacifier" which comprises a nipple member having an opening in its narrow tapered end of the vertical axis; a ring-shaped plate member attached to the nipple member defining a chamber to contain the medicine and containing an opening which is located on the verticle axis in alignment with the opening in the nipple member; an injection port stopper attached to and extending through the ring-shaped plate member into the chamber, the injection port stopper having the property of self-sealing should it be permeated with a needle; and a sealing rod extending through the opening in the ring-shaped plate member along the verticle axis and the opening in the nipple member.

13. The medicinal container according to 12 wherein the nipple member, ring-shaped plate member and injection port stopper are composed of resilient material, such as rubber, plastic, film, Gum Rubber or silicone.

14. The medicinal container according to claim 13 wherein the ring-shaped plate member is attached to the nipple member by threads forming an air-tight attachment.

15. The medicinal container according to claim 14 wherein the injection-port stopper forms an air-tight snap joint with the ring-shaped plate member.

16. The medicinal container according to claim 15 wherein the sealing rod forms an air-tight snap joint with the ring-shaped plate member and an air-tight compression seal with the nipple member.

17. The medicinal container according to claim 12 wherein the injection-port stopper forms an air-tight snap joint with the ring-shaped plate member.

18. The medicinal container according to claim 12 wherein the sealing rod forms an air-tight snap joint with the ring-shaped plate member and an air-tight compression seal with the nipple member.

19. The medicinal container according to claim 12 wherein the chamber contains a vacuum.

20. The medicinal container according to claim 13 wherein the chamber contains a vacuum.

21. The medicinal container according to claim 12 wherein the chamber is air-tight and contains a liquid.

22. The medicinal container according to claim 13 wherein the chamber is air-tight and contains a liquid.

23. The medicinal container according to claim 12 wherein the chamber is air-tight and contains a powder or solid.

24. The medicinal container according to claim 13 wherein the chamber is air-tight and contains a powder or solid.

25. A medicinal container according to claim 21 which contains an atmosphere of nitrogen gas above the medicament to prevent or retard oxidation of oxygen sensitive medicaments such as vitamins.

26. A medicinal container according to claim 12 composed of a transparent nipple member having graduations of volume or dose strength inscribed thereon affording a verification as to the amount of medicament contained in the air-tight chamber cavity.

27. A medicinal container according to claim 12 composed of low Ultra-Violet light transmitting materials.

28. A medicinal container according to claim 12 composed entirely of Gum Rubber or silicone.

29. A method of administering a liquid medicament to an infant, child or animal which comprises removing the sealing rod from a container comprising a nipple member having an opening in its narrow tapered end of the verticle axis, a ring-shaped plate member attached to the nipple member defining an air-tight chamber containing the liquid medicament and containing an opening which is located on the verticle axis in alignment with the opening in the nipple member, an injection port stopper attached to and extending through the ring-shaped plate member into the chamber, the injection port stopper having the property of self-sealing should it be permeated with a needle, and a sealing rod extending through the opening in the nipple member; introducing the opening in the nipple member into the mouth of an infant, child or animal; and squeezing the nipple member while the opening in the ring-shaped member is covered or sealed.

30. A method of administering a liquid medicament to an infant, child or animal which comprises removing the sealing rod from a container comprising a nipple member having an opening in its narrow tapered end of the vertical axis, a ring-shaped plate member attached to the nipple member defining an air-tight chamber containing the liquid medicament and containing an opening which is located on the verticle axis in alignment with the opening in the nipple member, an injection port stopper attached to and extending through the ring-shaped plate member into the chamber, the injection port stopper having the property of self-sealing should it be permeated with a needle, and a sealing rod extending through the opening in the ring-shaped plate member along the verticle axis and the opening in the nipple member; introducing the opening in the nipple member into the mouth of an infant, child or animal and permitting said infant, child or animal to suck on the container.

31. The method of claim 30 wherein the nipple member, ring-shaped plate member and the injection-port member are composed of a resilient material such as rubber, plastic, film, Gum Rubber or silicone.

* * * * *